US011933134B2

(12) United States Patent
Rustin et al.

(10) Patent No.: US 11,933,134 B2
(45) Date of Patent: Mar. 19, 2024

(54) REMOVABLE OIL WELL SEAL

(71) Applicant: CAN Holdings, LLC, Tallahassee, FL (US)

(72) Inventors: Neil Rustin, Leslie, GA (US); Ann Copple, Cleveland, OK (US); Craig Brown, Cleveland, OK (US)

(73) Assignee: CAN Holdings, LLC, Tallahassee, FL (US)

( * ) Notice: Subject to any disclaimer, the term of this patent is extended or adjusted under 35 U.S.C. 154(b) by 0 days.

(21) Appl. No.: 17/702,566

(22) Filed: Mar. 23, 2022

(65) Prior Publication Data

US 2022/0307340 A1 Sep. 29, 2022

Related U.S. Application Data

(60) Provisional application No. 63/164,937, filed on Mar. 23, 2021.

(51) Int. Cl.
*E21B 33/128* (2006.01)
*E21B 47/002* (2012.01)

(52) U.S. Cl.
CPC ..... *E21B 33/128* (2013.01); *E21B 47/002* (2020.05)

(58) Field of Classification Search
CPC ..... E21B 33/128; E21B 47/002
See application file for complete search history.

(56) References Cited

U.S. PATENT DOCUMENTS

| | | | | | |
|---|---|---|---|---|---|
| 3,358,760 | A * | 12/1967 | Blagg | E21B 23/00 | 166/207 |
| 5,718,291 | A * | 2/1998 | Lorgen | E21B 17/06 | 166/377 |
| 5,957,195 | A * | 9/1999 | Bailey | E21B 43/106 | 166/207 |
| 2005/0161226 | A1* | 7/2005 | Duggan | E21B 43/105 | 166/207 |
| 2007/0127780 | A1* | 6/2007 | Tawfiq | E21B 47/002 | 382/109 |
| 2008/0236230 | A1* | 10/2008 | Brisco | E21B 29/10 | 72/58 |
| 2013/0206426 | A1* | 8/2013 | Whiddon | E21B 43/103 | 166/383 |
| 2015/0354339 | A1* | 12/2015 | Handy | E21B 47/002 | 166/381 |
| 2018/0347289 | A1* | 12/2018 | Bennett | E21B 17/042 | |
| 2019/0323307 | A1* | 10/2019 | George | E21B 47/12 | |
| 2020/0325748 | A1* | 10/2020 | Sanchez | E21B 34/14 | |

* cited by examiner

*Primary Examiner* — Taras P Bemko
(74) *Attorney, Agent, or Firm* — Westman, Champlin & Koehler, P.A.; Z. Peter Sawicki; Amanda M. Prose

(57) ABSTRACT

A method of sealing a well having a casing wall comprises transporting a camera into the casing wall making a visual recording by visually recording perforations, microfractures or other breach type damages of the wall and vertical location thereof on the wall. Selecting a vertical location for sealing the well, the vertical location being determined from the visual recording. Transporting an expandable sealing device being made of an expandable metal and a hydraulic cylinder attached to the sealing device by a shear pin into the well. Expanding the sealing device to engage the casing wall such that a gas seal is made between the sealing device and the casing wall, the sealing device being expanded through engagement by the hydraulic cylinder.

7 Claims, 3 Drawing Sheets

REMOVABLE OIL WELL SEAL

CROSS-REFERENCE TO RELATED APPLICATIONS

This application claims priority to and the benefit of U.S. provisional patent application Ser. No. 63/164,937, filed on Mar. 23, 2021, the contents of which are incorporated herein in its entirety.

BACKGROUND

This disclosure relates to the sealing of orphaned and abandoned wells.

For decades, issues relating to orphaned and abandoned wells (groundwater intrusion, methane, and other natural gas emissions) have plagued both the oil industry and environmental agencies. A primary factor preventing a viable solution has been simple economics. A large expenditure is required to cap a well with no opportunity for future cost recovery. The most common technique currently being utilized to prohibit the escape of gasses into the atmosphere from abandoned and/or orphaned wells is to fill the wellbore with cement. This process is expensive and quite costly. In addition, once a well is "plugged" using currently used techniques such as plugging with cement, the well and any oil or gas found within that well can no longer be accessed through the plugged wellbore.

SUMMARY

A method of sealing a well having a casing wall is described herein. The method comprises transporting a camera into the casing wall making a visual recording by visually recording perforations, microfractures or other breach type damages of the wall and vertical location thereof on the wall. Selecting a vertical location for sealing the well, the vertical location being determined from the visual recording. Transporting an expandable sealing device being made of an expandable metal and a hydraulic cylinder attached to the sealing device by a shear pin into the well. Expanding the sealing device to engage the casing wall such that a gas seal is made between the sealing device and the casing wall, the sealing device being expanded through engagement by the hydraulic cylinder.

In a further embodiment, the sealing device is positioned above the perforations, microfractures or other breach type damages of the wall.

In a further embodiment, the sealing device is expanded to an engagement point with the casing wall such that the engagement with casing wall breaks the shear pin.

In a further embodiment, the expandable metal comprises brass.

In yet another embodiment, an apparatus for sealing a well is described. The apparatus comprises a hydraulic cylinder having a rod extending therethrough, the rod having a lower end with a shear pin attached to the lower end of the rod. An expandable sealing device is attached to the shear pin with the expandable sealing device being sufficiently expandable to engage the casing wall with sufficient force to shear the shear pin.

In a further embodiment, the expandable sealing device is made of an expandable brass.

In a further embodiment, the expandable sealing device comprises an expandable seal casing and a wedge device that is attached to the hydraulic cylinder by the shear pin.

DETAILED DESCRIPTION

A compression sealing process of this disclosure is used to seal nonproducing oil wells in an impermanent manner to stop the escape of gas such as methane into the environment. The process includes three steps for sealing such a well even if the wall of the well casing has been perforated or otherwise ruptured. The process of this disclosure seals the well in a manner further disclosed herein that can be easily unsealed and at a cost substantially less than presently known methods of unsealing wells.

The technique disclosed herein will shut off all gases coming out of the well and provides proof that no gas is leaking from the well. Additionally, the process described herein, allows the integrity of the pipe to be thoroughly checked to ensure no cross contamination. Further should the owner of the wellbore later determine that the gas or oil should be reclaimed, the seal can be removed allowing the owner to make the previously sealed well operational and income producing again.

Briefly stated, in an initial step a camera is lowered inside the casing of an oil well to check the integrity of the pipe, and to locate any perforations such a microfractures or other breach type damage resulting in perforations or holes in the pipe wall. The terms casing and pipe will be used interchangeably herein. The camera 24 is lowered all the way to the bottom of the pipe 14 recording and located the vertical position of perforations in the pipe 14. The location of the perforations and their positions are documented in a video recording. The video recording is used to determine at what depth a compression seal of this disclosure will be positioned within the pipe. The camera 24 is then removed from the well by a winch.

Figure 1:
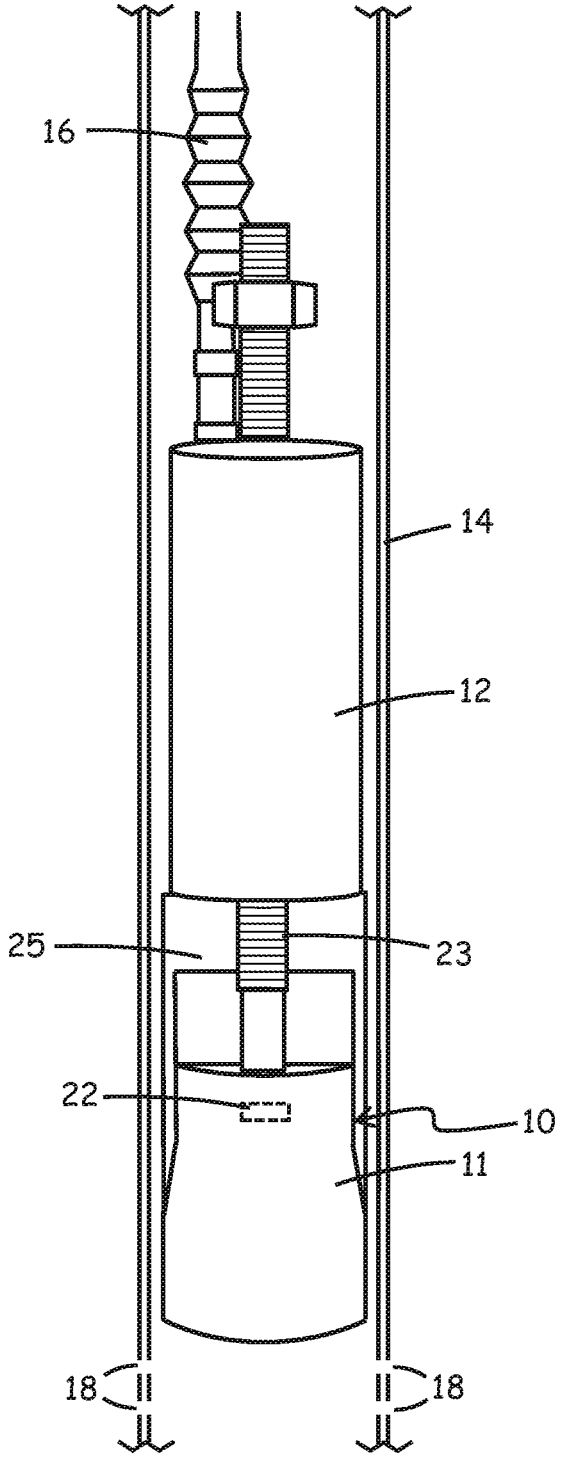
FIG. 1 is an elevational view of the seal in a casing wall shown in sectional view.
Figure 2:
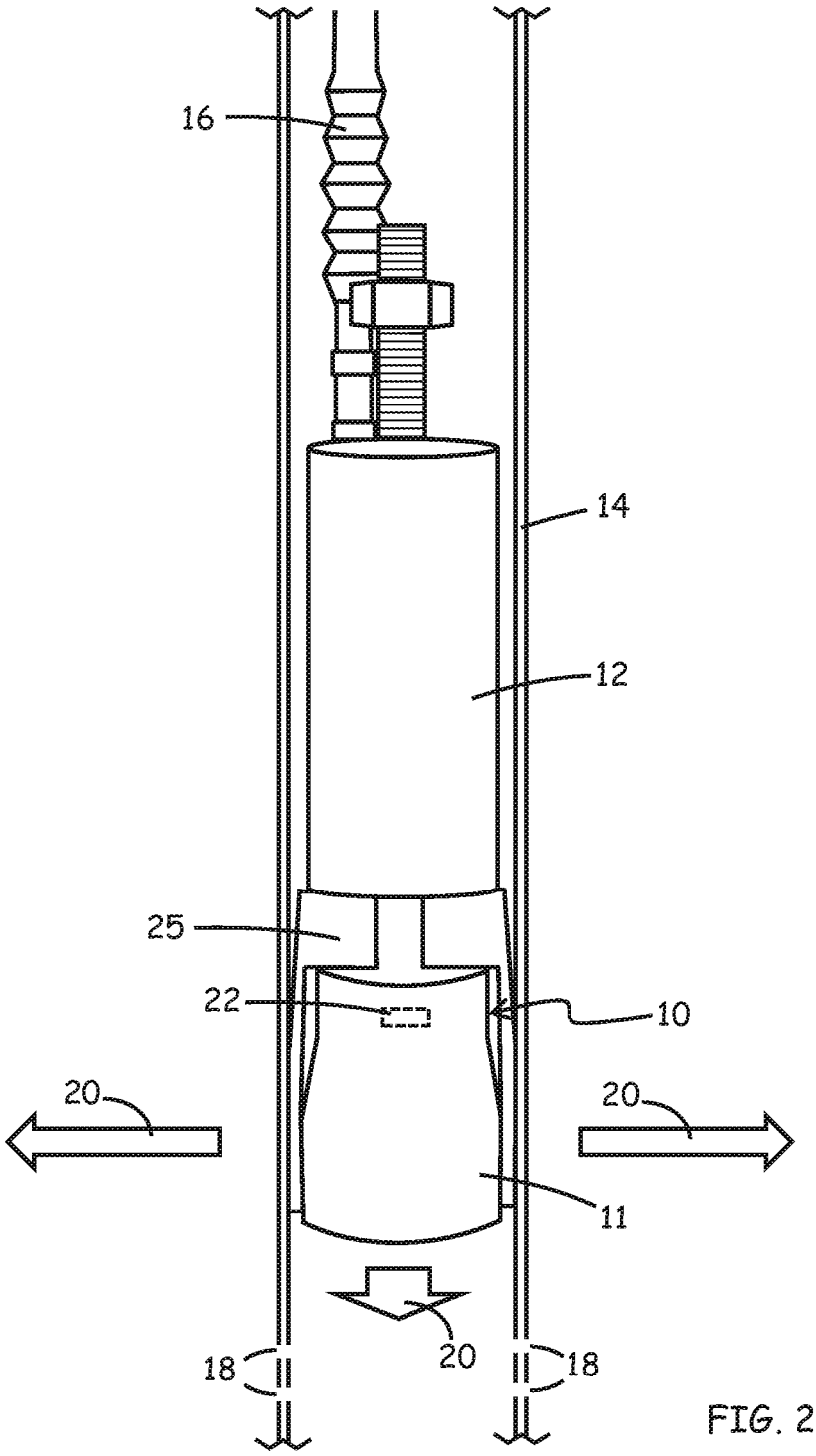
FIG. 2 is an elevational view of the seal in a casing wall shown in sectional view with the compression seal shown in engagement.
Figure 3:
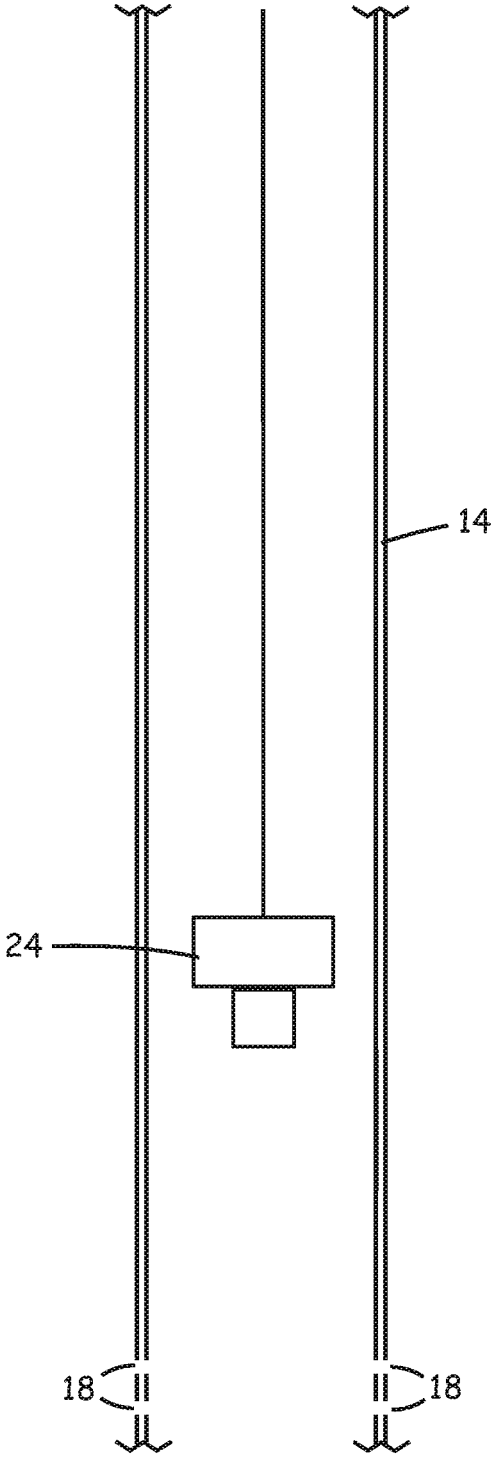
FIG. 3 is an elevational view of a camera lowered into the well casing for inspection.

The second step as illustrated in the FIGS. 1 and 2 includes lowering the compression seal 10 and a hydraulic cylinder 12 using the winch (not shown) into the well casing 14 via a hydraulic umbilical cord 16. The compression seal 10 is lowered into the well casing 14 to a selected depth just above the perforations 18 determined from the video taken by the camera in the previous step. The hydraulic cylinder 12 is actuated to expand the compression seal against wall of the pipe, as illustrated by arrows 20 sufficiently to set the seal against the casing wall 14. It has been found that 3500 lbs. is sufficient to provide a compression seal that will stop further gas leakage into the environment.

The compression seal 10 comprises a wedge 11 and a seal casing 25. The seal casing 25 is made of an expandable metal having sufficient expansion characteristics to engage the casing wall to withstand pressure buildup by leaking gas or other fluids. In one embodiment the seal casing of this disclosure withstood 200 psig. The expandable metal preferably can withstand salt corrosion. One satisfactory expandable metal was C36000 brass which has an approximate composition of 60 to 63% copper, 2.5 to 3.0% lead, approximately 0.35% iron and the remainder zinc. The zinc content aids in the brass to be expanded while also making the seal less susceptible to salt corrosion. However, other suitable expandable metals that meet the criteria herein discussed are also within this disclosure. In addition, the seal casing can be made of Teflon, polytetrafluoroethylene.

The wedge 11 is preferably made of a stiff bronze aluminum alloy. However, other suitable metals or materials that can engage the seal casing described herein are contemplated in this disclosure.

The hydraulic cylinder 12 has a threaded rod 23 that projects downwardly to connect to the compression seal via a shear pin 22. The threaded rod extends through the seal casing 25 positioned between the hydraulic cylinder 12 and the expandable sealing device 10. The wedge 11 engages the seal casing resulting in forces being extended into the seal casing resulting in the seal casing to expand as indicated by arrows 20.

When the hydraulic cylinder is actuated, the threaded rod moves upwardly to move the wedge 11 up into the seal casing 25. When the pressure to the seal casing is increased to 4500 lbs., the shear pin 22 will shear, releasing the hydraulic cylinder 12 from the wedge 11.

The shear pin 22 breaks due to the engagement of the seal casing 25 to the casing wall 14. The hydraulic cylinder 12 and shear pin 22 are then retrieved from the well by the hydraulic umbilical cord 16 using the winch (not shown) located at the top of the ground.

In the third step the camera 24 is again lowered via the winch to the depth of the compression seal. The camera is used to record on video whether the compression seal has eliminated gas bubbles. The occurrence or nonoccurrence of gas bubbles is recorded on video. If no gas bubbles are recorded then the compression seal has been placed correctly since no gas is escaping past the compression seal. The winch is then used to retrieve the camera from the well. Thus, the compression seal positioned in the well successfully abates all gases from exiting the well below the compression seal.

Since the seal of this disclosure is made an expandable metal, the seal may be removed quite easily by simply drilling the seal out. Having a removable seal on the well keeps the well intact for future use if economics justify making the well active once again.

Example

Owing to the cost and time required to plug an actual well, an alternative methodology was used to determine the sealing ability of the seal of this disclosure, Methane emission was chosen to evaluate the sealing capability.

Testing on Small Casing

Small casing was chosen for this example with the purpose to pressurize the gas abatement seals of this disclosure at 200 or more psi for an extended period of time. Small casing is more representative of average wellbore characteristics, and holding this amount of pressure would prove useful for mitigating the leakage of harmful greenhouse gases from forgotten oil and gas wells.

Two gas abatement seals were tested. One of the seals was constructed of brass, and the other was constructed of Teflon. Initially, the seals were tested for safety using hydrostatic pressure. This was to prevent any blowout that may occur during the first pressurization with gas that these seals endured.

Each seal held just over 250 psig during a testing time of roughly 15 minutes. Water was used as the pressurizing liquid, and no water could be seen dripping at the open ends of the tanks. This led to a safe and confident pressurization process with natural gas later.

The next phase of testing on the gas abatement seals was done with gas pressurization. On the same day as the hydrostatic pressure test, the sealed chambers were emptied of all water and taken to a safe area. There was no earlier delineation between the two types of seals given when pressure testing, as both seals would experience the same testing. The seals were to be characterized by material after testing was completed to understand which one performed better.

Ambient temperature was recorded; however, the direct gas temperature was not recorded. This proved difficult for analyzing pressure loss through graphical analysis or by applying the equation of state. The temperature sensor was receiving sunlight at different times of the day, while the gas abatement seals were frequently covered by shade due to their necessity of being put in a safe and covered location. A simple test was done to check for gas leakage later by calibrating a handheld gas sensor to the open atmosphere. This sensor detected the presence of combustible gases and was useful for detecting leaks while the seals were pressurized with natural gas. This secured the notion that not only would natural gas be an accurate experimental representation of these gas abatement seals in the field, but it would also be helpful in determining if a leak was present. Since natural gas is lighter as compared to gas, the seals were installed in reverse configuration to ensure that any leaked gas would stay in the top part of the evaluated casing and could be sensed by a methane sensor. Tulsa city natural gas was used for these experiments (see Table 1) that comprised more than 93% of methane.

TABLE 1

Natural gas composition

| Component | MW | Mol ¾ |
|---|---|---|
| Methane | 16.04 | 93.14 |
| Ethane | 30.07 | 3.82 |
| Propane | 44.09 | 1.60 |
| Butanes | 58.1 | 0.76 |
| Pentane | 72.15 | 0.37 |
| Hexanes | 86.17 | 0.10 |
| CO2 | 44.01 | 0.20 |
| | Total | 100 |

Natural gas pressurization started on day 1 and measurements were taken through Day 7 using the data acquisition system Delta V and Rosemount sensors. The initial pressure of each seal was 237 psig for P1 and 234 psig for P2. This was recorded at an initial ambient temperature of 69 OP. The final recordings during this test were at an ambient temperature of 66° P with P1 at 235 psig and P2 at 232 psig. This does not show an evident drop in pressure, as after 7 days pressurized, the pressure on each gas abating seal dropped by 2 psig with an ambient temperature drop of 3° P.

The seals remained under pressure for 18 days with no noticeable deviations at the face of the pressure sensor. It was during this 18-day period that natural gas sniffers were used in determining if a leak was present at the seals. This period also determined which casing held which seal (brass or Teflon (polytetrafluoroethylene). First, an EXTECH EZ40 EzFlex™ Combustible Gas Detector sensitive to 10 ppm was used to find the presence of any combustible gas present in the casing underneath the seal. Since methane is the focus, it was the gas that the detectors were specifically made to find. Additionally, methane is lighter than air, therefore it would be trapped underneath the seal since the casing had been stored vertically with the pressurized half being above the seal and an open bottom present below. Using this initial detector, the device was calibrated to open air and then the 'sniffing' end was extended up into the bottom of the casing. No noticeable difference in beeping intervals (the beeping noise from a natural gas detector would rise in interval speed if combustible gas was present) was found, indicating no presence of a combustible natural gas such as methane. This test was repeated with the same results using a UEI Test Instruments CD100A Combustible Gas Leak Detector sensitive to 50 ppm methane. An additional, more accurate detector was used in a final test on day 18. This detector was the SENIT® HXG-3 Combustible Gas Leak Detector that is sensitive to 1 ppm of combustible gas. This detector is also capable of showing the ppm that it is reading, as well as the lower explosive limit of the gas that it may be detecting. The same results were obtained from this final test, showing a concentration of 0 ppm combustible gas present in the seal casings. This was the final test done on an average well casing for each seal, and it was shown that P2 represented the Teflon seal while P1 represented the brass seal. This information was appreciated, however, both seals performed well in all testing, and no differences were noted regarding their performance.

Testing on Large Casing

The final phase of testing was done on the brass seal only. The objective of this test was to find the ultimate pressure that the brass seal would hold without allowing fluid leakage. This was done by placing the gas abatement seal into a 5.5-inch diameter pipe with a very high minimum internal yield pressure of 10,640 psi.

This test, like the small casing test, was done using hydrostatic pressure with oil as the pressurizing fluid. One gauge was attached to the top of the casing in addition to the one already attached to the pressurizing device. There existed one issue with the testing, and that was due to the brass's inability to join with such an experimentally durable casing. This was ultimately remedied by inserting a 1.25-inch rod underneath the seal in order to hold it in place during pressurization, changing the motive of the test to specifically looking for fluid leakage at the places where the seal joined the casing. Without the rod in place, the seal was holding back the fluid, yet sliding slowly through the casing and would have ended once the pressure was high enough to slide the seal out of the bottom of the casing.

The results of the test ended with this 1.25-inch rod shearing against the large casing. The pressurization was stopped at that point, reaching a total of 10,000 psig with no oil coming from the pressurized side of the seal. The gas abatement seal held 10,000 psi without letting fluid through the large casing.

What is claimed is:

1. A method of sealing a well having a casing wall, the method comprising:

transporting a camera into a casing of the well and making a visual recording of the casing wall by visually recording perforations, microfractures or other breach type damages of the casing wall and one or more vertical locations thereof on the wall as the camera is transported into the casing and then removing the camera from the casing;

selecting a vertical location for sealing the well, the vertical location being one of the one or more vertical locations determined from the visual recording;

transporting a seal into the casing wherein the seal comprises a wedge and an expandable sealing device being made of an expandable metal and a hydraulic cylinder having a rod extending through the sealing device positioned between the hydraulic cylinder and the seal, an end of the rod having a shear pin attached thereto; and expanding the sealing device to engage the casing wall such that a gas seal is made between the sealing device and the casing wall, the sealing device being expanded through engagement by and actuation of the hydraulic cylinder as the rod engages the wedge into the expandable sealing device.

2. The method of claim 1 wherein the sealing device is positioned above the perforations, microfractures or other breach type damages of the wall.

3. The method of claim 1 wherein the sealing device is expanded to an engagement point with the casing wall such that the engagement with casing wall breaks the shear pin.

4. The method of claim 1 wherein the expandable metal comprises brass.

5. An apparatus for sealing a well, the apparatus comprising:

a hydraulic cylinder having a rod extending therethrough, the rod having a lower end;

a shear pin attached to the lower end of the rod;

an expandable sealing device being attached to the shear pin as the rod extends through the expandable sealing device, the expandable sealing device being sufficiently expandable via actuation of the hydraulic cylinder to engage a casing wall with sufficient force to shear the shear pin.

6. The apparatus of claim 5 wherein the expandable sealing device is made of an expandable brass.

7. The apparatus of claim 5 and further comprising an expandable seal casing and a wedge device that is attached to the hydraulic cylinder by the shear pin.

* * * * *